US011567439B2

(12) United States Patent
Soeta et al.

(10) Patent No.: US 11,567,439 B2
(45) Date of Patent: Jan. 31, 2023

(54) COLOR MEASUREMENT DEVICE THAT AVOIDS DIRT ON REFERENCE SURFACE OF WHITE REFERENCE PLATE AND IMAGE FORMING APPARATUS

(71) Applicant: CANON KABUSHIKI KAISHA, Tokyo (JP)

(72) Inventors: Yukihiro Soeta, Kanagawa (JP); Teppei Nagata, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/571,778

(22) Filed: Jan. 10, 2022

(65) Prior Publication Data

US 2022/0236680 A1 Jul. 28, 2022

(30) Foreign Application Priority Data

Jan. 22, 2021 (JP) ..... JP2021-008888

(51) Int. Cl.
*G03G 15/00* (2006.01)
*G03G 15/01* (2006.01)
*G03G 15/08* (2006.01)

(52) U.S. Cl.
CPC ..... *G03G 15/5054* (2013.01); *G03G 15/01* (2013.01); *G03G 15/0806* (2013.01); *G03G 15/5041* (2013.01); *G03G 15/5062* (2013.01)

(58) Field of Classification Search
CPC ..... G03G 15/5054; G03G 15/01; G03G 15/0806; G03G 15/5041; G03G 15/5062
See application file for complete search history.

(56) References Cited

U.S. PATENT DOCUMENTS

2013/0162998 A1* 6/2013 Furuta ..... B41J 2/04558 356/402
2014/0093262 A1* 4/2014 Kamei ..... G03G 15/5058 399/49
2014/0185114 A1* 7/2014 Takemura ..... G03G 15/5062 358/504
2020/0117130 A1* 4/2020 Itagaki ..... G03G 15/5062

FOREIGN PATENT DOCUMENTS

JP 2013054324 A 3/2013

* cited by examiner

*Primary Examiner* — Sandra Brase
(74) *Attorney, Agent, or Firm* — Rossi, Kimms & McDowell LLP

(57) ABSTRACT

A color measurement device includes a conveying roller unit that conveys a sheet in a conveying direction, a color sensor that is movable in a direction orthogonal to the conveying direction and measures a color of an image formed on the sheet, a white reference plate having a reference surface for measurement by the color sensor for calibration of the color sensor, lifting rollers that move with the color sensor and retain the sheet, and slid-on members that protrude to a level higher than the reference surface in a perpendicular direction to the reference surface. When the color sensor moves such that at least part of the lifting rollers overlaps the white reference plate as viewed from the perpendicular direction, the lifting rollers are brought into contact with the slid-on members, whereby a space is formed between the lifting rollers and the reference surface.

12 Claims, 15 Drawing Sheets

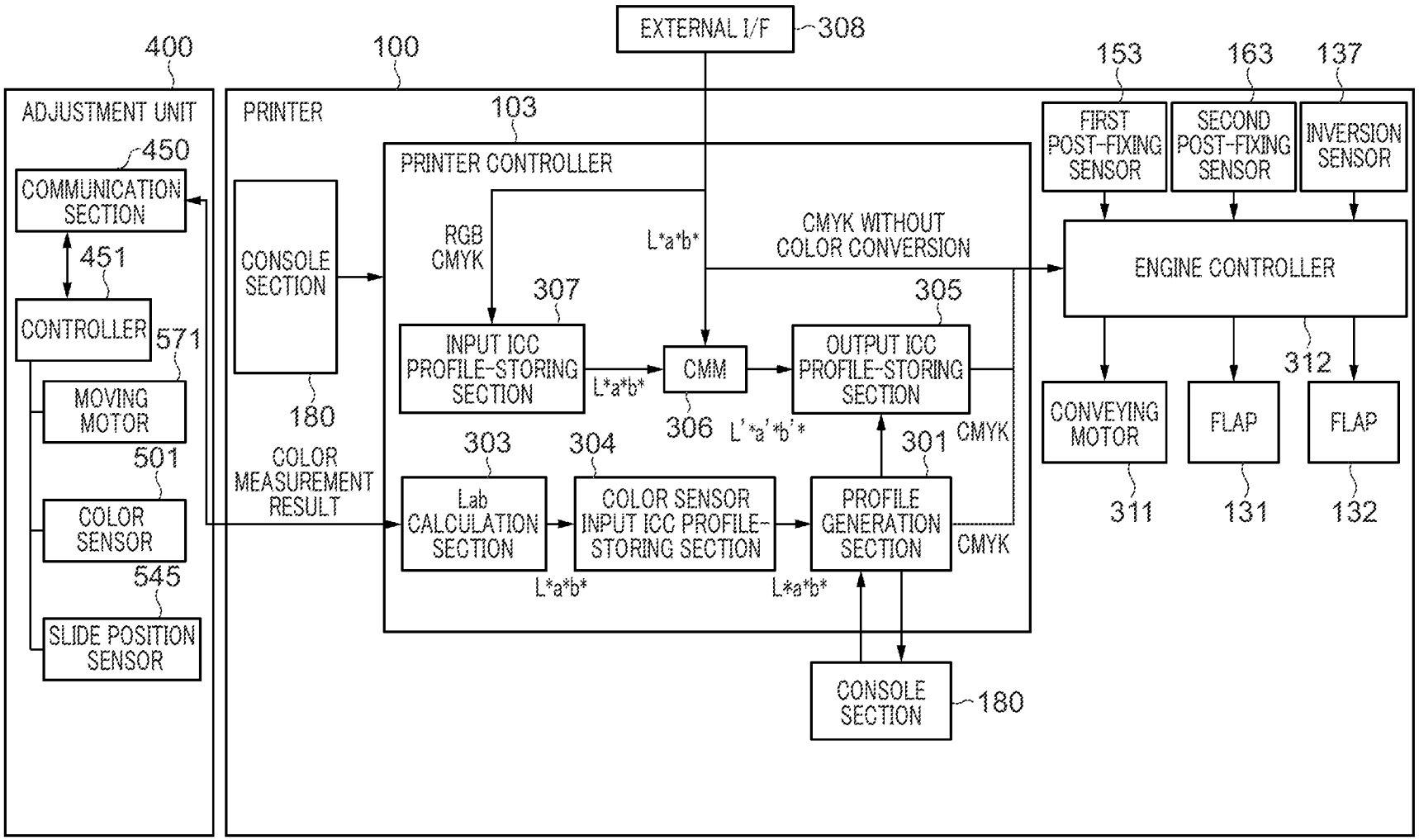
FIG. 3
PRINTER
100
PRINTER CONTROLLER
103
EXTERNAL I/F
308
CONSOLE SECTION
180
COLOR MEASUREMENT RESULT
RGB CMYK
INPUT ICC PROFILE-STORING SECTION
307
L*a*b*
CMM
306
L'*a'*b'*
CMYK WITHOUT COLOR CONVERSION
OUTPUT ICC PROFILE-STORING SECTION
305
CMYK
Lab CALCULATION SECTION
303
L*a*b*
COLOR SENSOR INPUT ICC PROFILE-STORING SECTION
304
L*a*b*
PROFILE GENERATION SECTION
301
CMYK
CONSOLE SECTION
180
FIRST POST-FIXING SENSOR
153
SECOND POST-FIXING SENSOR
163
INVERSION SENSOR
137
ENGINE CONTROLLER
312
CONVEYING MOTOR
311
FLAP
131
FLAP
132
ADJUSTMENT UNIT
400
COMMUNICATION SECTION
450
451
CONTROLLER
571
MOVING MOTOR
501
COLOR SENSOR
545
SLIDE POSITION SENSOR

*FIG. 7* size: 270176 bytes
CMMType: 'appl'
version: 0x02002001
profileClose: 'prtr'
dataColorSpace: 'CMYK'
interchangeSpace: 'XYZ'
CreationDate: 3.4.1996, 19:46:14
CS23ignature: 'acsp'

Header:

prim.platform: 'APPL'
flags: 0x00000000
deviceManufacture: 'EF1'
deviceModel: 0
deviceAttributes: 0x00000000, 0x00000000
renderlingIntent: 2
white XYZ: X=0.9642, Y=1.0000, Z=0.8249

Tag Table: <10 elements, double-click to inspect>

| Ind | Signet. | elementoffset | size |
|---|---|---|---|
| 0 | 'A2B0' | 252 = 0x000000FC | 43002 |
| 1 | 'B2A0' | 43256 = 0x0000A8F8 | 42940 |
| 2 | 'A2B1' | 86196 = 0x00015084 | 43002 |
| 3 | 'B2A1' | 129200 = 0x0001F880 | 42940 |
| 4 | 'A2B2' | 172140 = 0x0002A06C | 43002 |
| 5 | 'B2A2' | 215144 = 0x00034868 | 42940 |
| 6 | 'gamt' | 258084 = 0x0003F024 | 11925 |
| 7 | 'desc' | 270012 = 0x00041EBC | 125 |
| 8 | 'cprt' | 270140 = 0x00041F3C | 14 |
| 9 | 'wtpt' | 270156 = 0x00041F4C | 20 |
| | | | |
| | | | |
| | | | |
| | | | |
| | | | |
| | | | |

COLOR MEASUREMENT DEVICE THAT AVOIDS DIRT ON REFERENCE SURFACE OF WHITE REFERENCE PLATE AND IMAGE FORMING APPARATUS

BACKGROUND OF THE INVENTION

Field of the Invention

The present invention relates to a color measurement device equipped with a function of measuring a color and an image forming apparatus provided with the color measurement device.

Description of the Related Art

In recent years, there has been known an image forming apparatus including a color measurement device, mounted inline in the vicinity of a sheet discharging section of a printer. Japanese Laid-Open Patent Publication (Kokai) No. 2013-54324 proposes an inline configuration of a color measurement device that improves the accuracy of detecting an image for measurement, which is formed on a recording medium, using a color sensor formed by a light source, a diffractive grating element, and a position detection sensor.

In general, as preparation for measurement of an image for measurement using a color sensor, a calibration operation using a white reference plate is carried out to stabilize the reading accuracy. The whiteness of the white reference plate used as the reference of color measurement using the color sensor is an important value to maintain the reading accuracy, and if a reference surface (front surface) of the plate becomes dirty or discolored, this reduces the measurement accuracy of the color sensor.

However, in a case where the color sensor is a fixed-type sensor as disclosed in Japanese Laid-Open Patent Publication (Kokai) No. 2013-54324, the color sensor and the white reference plate are disposed in a paper sheet passing area, and the white reference plate is disposed on a side opposite to the color sensor. In this arrangement, a protection shutter or the like is usually required to prevent the white reference plate from being made dirty by paper powder or being deteriorated by forced light emission. The protection shutter is moved by a moving mechanism so as to cover the white reference plate when a paper sheet passes or when forced light emission is performed, and to retreat when the calibration operation is carried out. This makes it possible to prevent the white reference plate from becoming dirty and deteriorated. However, a space for arranging the shutter is required, which complicates the configuration. The manufacturing cost of the image forming apparatus is also increased.

SUMMARY OF THE INVENTION

The present invention provides a color measurement device that is capable of avoiding dirt from being deposited on a reference surface of a white reference plate with a simple configuration and an image forming apparatus.

In a first aspect of the present invention, there is provided a color measurement device, including a conveying unit configured to convey a sheet in a conveying direction, a color measurement unit configured to be movable in a direction crossing the conveying direction, and measure a color of an image formed on the sheet conveyed by the conveying unit, a reference member having a reference surface measured by the color measurement unit for calibration of the color measurement unit, a retaining portion that moves together with the color measurement unit and retains the sheet for measurement by the color measurement unit, and a protruding portion that protrudes to a level higher than the reference surface in a direction perpendicular to the reference surface, wherein when the color measurement unit moves such that at least part of the retaining portion overlaps the reference member as viewed from the direction perpendicular to the reference surface, the retaining portion is brought into contact with the protruding portion, whereby a space is formed between the retaining portion and the reference surface.

In a second aspect of the present invention, there is provided an image forming apparatus, including an image forming unit configured to form an image on a sheet, a conveying unit configured to convey a sheet on which the image has been formed by the image forming unit in a conveying direction, a color measurement unit configured to be movable in a direction crossing the conveying direction, and measure a color of the image formed on the sheet conveyed by the conveying unit, a reference member that is disposed outside an area where the sheet conveyed by the conveying unit passes and has a reference surface measured by the color measurement unit for calibration of the color measurement unit, a retaining portion that moves together with the color measurement unit and retains the sheet for measurement by the color measurement unit, and a protruding portion that protrudes to a level higher than the reference surface in a direction perpendicular to the reference surface, wherein when the color measurement unit moves such that at least part of the retaining portion overlaps the reference member as viewed from the direction perpendicular to the reference surface, the retaining portion is brought into contact with the protruding portion, whereby a space is formed between the retaining portion and the reference surface.

According to the present invention, it is possible to avoid dirt from being deposited on the reference surface of the white reference plate with the simple configuration.

Further features of the present invention will become apparent from the following description of exemplary embodiments (with reference to the attached drawings).

BRIEF DESCRIPTION OF THE DRAWINGS

FIG. 3 is a control block diagram of a printer and the adjustment unit.

FIG. 7 is a diagram showing the structure of an output ICC profile.

DESCRIPTION OF THE EMBODIMENTS

The present invention will now be described in detail below with reference to the accompanying drawings showing embodiments thereof.

Figure 1:
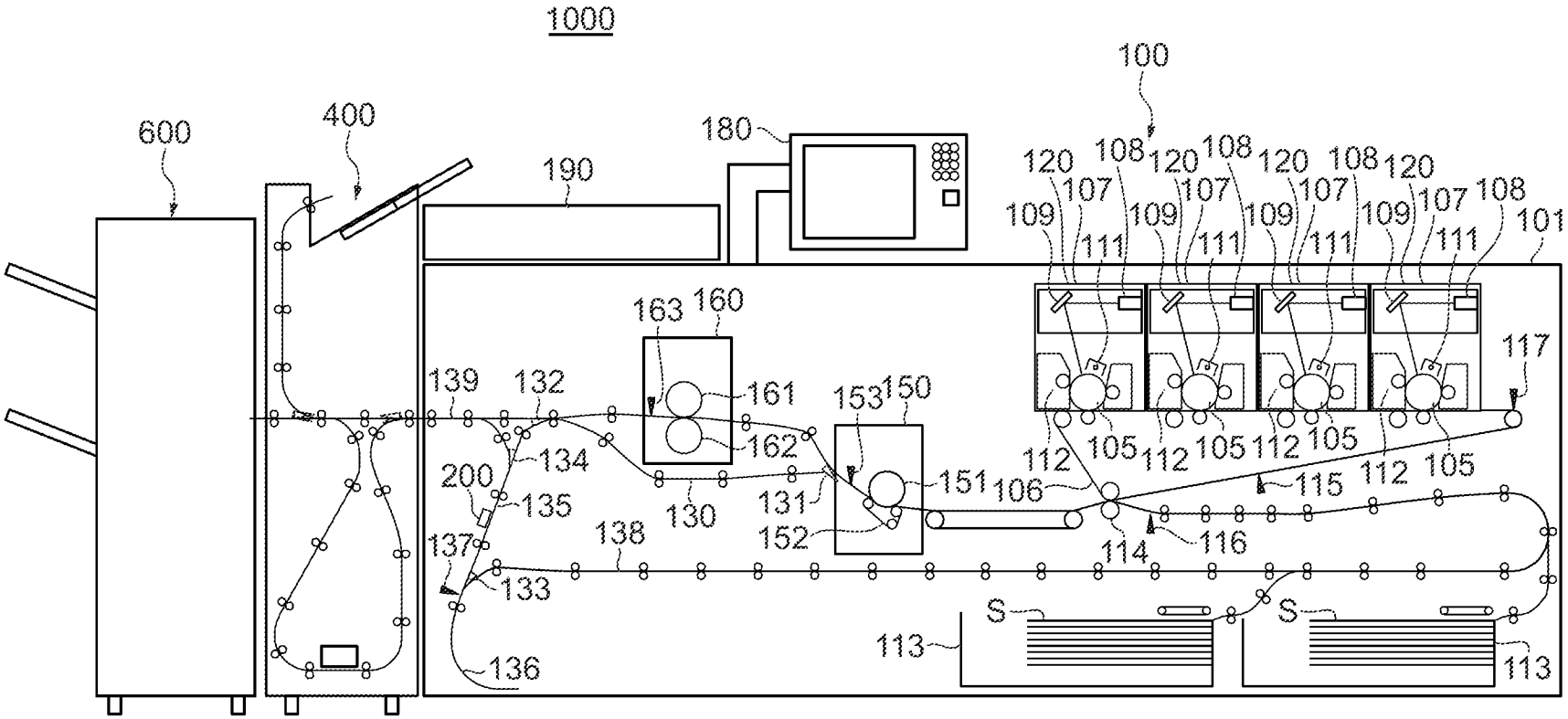
FIG. 1 is a view showing the whole configuration of an image forming system.

FIG. 1 is a view showing the whole configuration of an image forming system to which a color measurement device (hereinafter referred to as the color measuring unit) according to an embodiment of the present invention is applied. This image forming system, denoted by reference numeral 1000, includes a printer 100 which is an image forming apparatus, an adjustment unit 400, and a finisher 600. Although the printer 100 is an electrophotographic laser beam printer, any other suitable image forming apparatus, such as an inkjet printer or a dye sublimation printer, may be employed.

The printer 100 includes a housing 101. The housing 101 incorporates mechanisms forming an engine section, and a control board accommodating section that accommodates an engine controller 312 (see FIG. 3) that performs control associated with the respective print processing operations (such as sheet feeding) performed by the mechanisms and a printer controller 103 (see FIG. 3). The printer 100 includes an optical processing mechanism and a fixing mechanism for forming an image on a recording material by performing an electrophotographic process, and a feed mechanism and a conveyance mechanism for feeding and conveying a sheet S used as a recording material.

The optical processing mechanism includes four stations 120 that form toner images of yellow, magenta, cyan, and black colors, respectively, and an intermediate transfer member 106. In each of the stations 120, a surface of a photosensitive drum 105 which is a drum-shaped photosensitive member is charged by a primary charger 111. A laser scanner section 107 exposes the photosensitive drum 105 based on a command signal generated based on image data and received from the printer controller 103. The laser scanner section 107 includes a laser driver that drives a semiconductor laser 108 that emits a laser beam, on and off, and guides the laser beam emitted from the semiconductor laser 108 to the photosensitive drum 105 via a reflection mirror 109 while deflecting the laser beam in a main scanning direction using a rotary polygon mirror. With this, an electrostatic latent image corresponding to the image data is formed on the surface of the photosensitive drum 105.

A developing device 112 stores developer containing toner therein and supplies charged toner particles to the photosensitive drum 105. When the toner particles adhere to the drum surface according to surface potential distribution, the electrostatic latent image held on the photosensitive drum 105 is visualized as a toner image. The toner image held on each photosensitive drum 105 is transferred onto the intermediate transfer member 106 (primary transfer) to which a voltage of an opposite polarity to a normal charged polarity of toner is applied. In a case where a color image is formed, toner images formed by the four stations 120, respectively, are multiply transferred onto the intermediate transfer member 106 such that the toner images are superposed one upon another, whereby a full-color toner image is formed on the intermediate transfer member 106. On the other hand, the feed mechanism feeds sheets S from a sheet container 113 to a transfer roller 114 one by one. When the sheet S is brought into pressure contact with the intermediate transfer member 106 by the transfer roller 114 and a bias having a polarity inverse to that of the toner is applied to the transfer roller 114 at the same time, the toner image held on the intermediate transfer member 106 is transferred onto the sheet S (secondary transfer).

Around the intermediate transfer member 106, there are arranged an image formation start position detection sensor 115 for determining a print start position when image formation is performed, a feed timing sensor 116 for controlling timing of feeding a sheet S, and a density sensor 117. The density sensor 117 measures the density of an image for measurement (hereinafter referred to as "the measurement image"), held on the intermediate transfer member 106.

The fixing mechanism is formed by a first fixing device 150 and a second fixing device 160. The first fixing device 150 includes a fixed roller 151 for applying heat to a sheet S, a pressure belt 152 for bringing the sheet S into pressure contact with the fixed roller 151, and a first post-fixing sensor 153 for detecting completion of the fixing performed by the first fixing device 150. The rollers including the fixed roller 151 are hollow rollers, and each have a heater therein. The first fixing device 150 applies heat and pressure to a toner image on a sheet S while conveying the sheet S in a state held between the fixed roller 151 and the pressure belt 152. With this, the toner particles are melted and then fixed, whereby the image is fixed to the sheet S.

The second fixing device 160 is disposed on a passage for conveying the sheet S at a location downstream of the first fixing device 150. The second fixing device 160 has a function of increasing glossiness of the image on which the fixing has been performed by the first fixing device 150 and ensuring fixability of the image to the sheet S. The second fixing device 160 includes, similarly to the first fixing device 150, a fixed roller 161 and a pressure roller 162, and a second post-fixing sensor 163 for detecting completion of the fixing performed by the second fixing device 160.

Note that there is a case where it is unnecessary to pass the sheet S through the second fixing device 160 depending on a type of the sheet S. To cope with this case, the printer 100 has a bypass conveying path 130 for discharging a sheet S without passing the sheet S through the second fixing device 160 for the purpose of reducing energy consumption. The sheet S conveyed from the first fixing device 150 is selectively guided by a flap 131 to one of the second fixing device 160 and the bypass conveying path 130.

The sheet S having passed through the second fixing device 160 or the bypass conveying path 130 is selectively guided by a flap 132 to one of a discharge conveying path 139 and an inversion conveying path 135. The position of the sheet S guided to the inversion conveying path 135 is detected by an inversion sensor 137, and the leading edge and the trailing edge of the sheet S in a sheet conveying direction are switched from each other by a switch-back operation performed by an inversion section 136. A flap 133 switches a direction of guiding the sheet S from the inversion section 136 such that the sheet S is conveyed into a reconveying path 138 or the inversion conveying path 135.

In a case where double-sided printing is performed, the sheet S having an image formed on a first side thereof is conveyed toward the transfer roller 114 again through the reconveying path 138 in a state in which the leading edge and the trailing edge have been switched from each other by the inversion section 136, whereby an image is formed on a second side thereof. The sheet S on which image formation by single-sided printing is completed or the sheet S on which image formation on the second side by double-sided printing is completed is discharged outside the printer 100 as the image forming apparatus through the discharge conveying path 139. Note that a flap 134 which can guide the sheet S switched-back by the inversion section 136 toward the discharge conveying path 139 is disposed between the inversion conveying path 135 and the discharge conveying path 139 to make it possible to select which of the front and reverse sides of the sheet S should face upward when the sheet S is discharged from the printer 100.

An image reading device 190 and a console section 180 serving as a user interface are disposed on a top side of the printer 100. The console section 180 has a display for displaying information to a user. Further, in the inversion conveying path 135, a color measuring unit 200 may be disposed.

Figure 2:
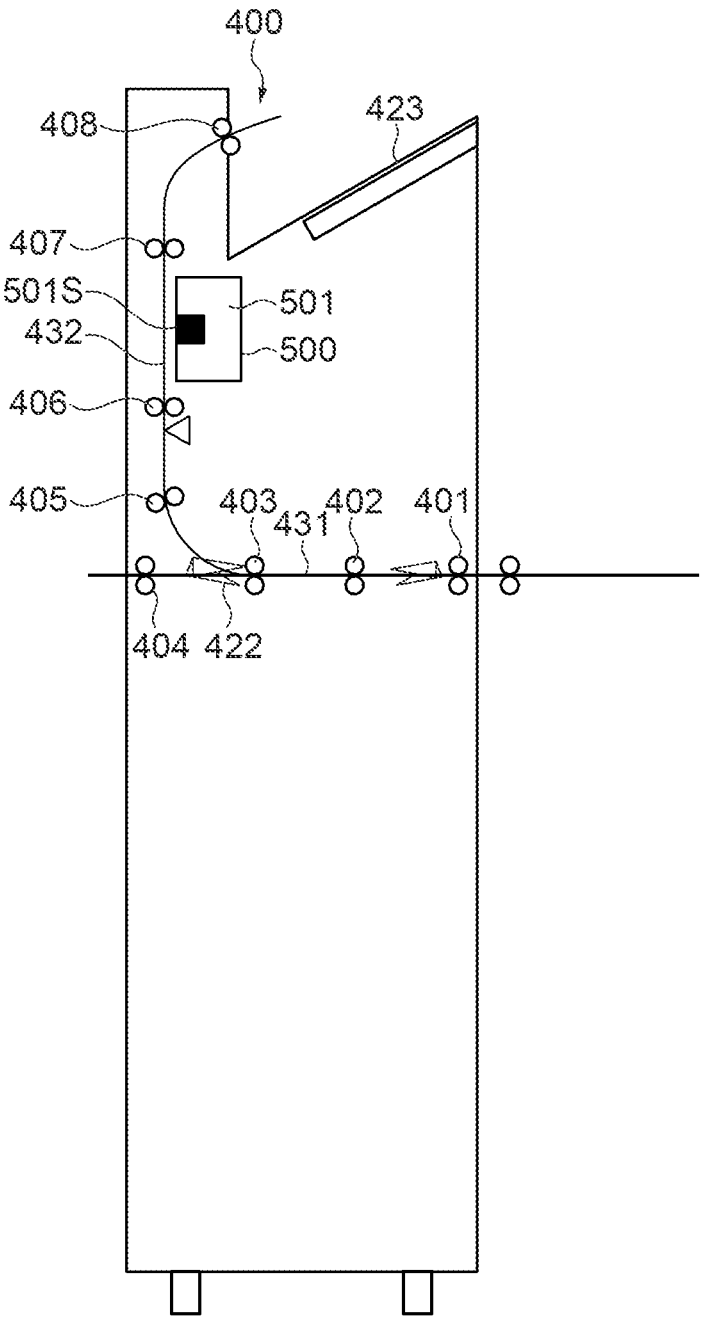
FIG. 2 is a cross-sectional view of an adjustment unit.

FIG. 2 is a cross-sectional view of the adjustment unit 400. The adjustment unit 400 as the color measurement device has a through path 431 forming a sheet conveying path. The through path 431 is a conveying path for receiving a sheet S discharged from the printer 100 and conveying the sheet S toward the finisher 600 and extends in a substantially horizontal direction. The through path 431 has a first roller 401, a second roller 402, a third roller 403, and a fourth roller 404, which are disposed from an upstream side to a downstream side in the sheet conveying direction in the mentioned order.

A discharge path 432 is a conveying path for discharging a sheet to a discharge space provided in the adjustment unit 400. The discharge path 432 branches from the through path 431 on a downstream side of the third roller 403 and extends upward from the through path 431 in a substantially vertical direction. A flap 422 that can switch the sheet conveying path between the through path 431 and the discharge path 432 is disposed at a branch portion where the discharge path 432 branches from the through path 431. The sheet S conveyed into the discharge path 432 is conveyed upward by conveying rollers 405, 406, and 407, disposed from a lower side toward an upper side in the mentioned order. A discharge roller 408 disposed on a most downstream portion (topmost portion) of the discharge path 432 discharges a sheet out of the adjustment unit 400, whereby the sheet is stacked on a discharge stacking section 423.

A color measuring unit 500 is disposed in the discharge path 432. The color measuring unit 500 has a color sensor 501 (color measurement unit). The color sensor 501 measures the color of an image (such as a measurement image) formed on a sheet S passing through the discharge path 432, at a reading portion 501S thereof. Note that in FIG. 2, illustration of a second path in lower half part is omitted. The second path is a path that branches from a portion where the first roller 401 is disposed and extends to the third roller 403 without passing through the second roller 402. The measuring unit 500 may be disposed in the second path.

FIG. 3 is a control block diagram of the printer 100 and the adjustment unit 400. The printer 100 includes, as components for control operation, the printer controller 103, the console section 180, and the engine controller 312, which are communicably interconnected. The printer controller 103 performs centralized control of the image forming system 1000. The printer controller 103 includes a profile generation section 301, a Lab calculation section 303, and a color sensor input ICC profile-storing section 304. Further, the printer controller 103 includes an output ICC profile-storing section 305, a CMM (color management module) 306, and an input ICC profile-storing section 307.

The engine controller 312 performs control for forming an image on a sheet S based on a command signal delivered from the printer controller 103. For example, the engine controller 312 controls the operation of not only a conveying motor 311 that drive rollers for conveying a sheet S, but also the operations of the flaps 131 and 132, based on detection signals output from the first post-fixing sensor 153, the second post-fixing sensor 163, and the inversion sensor 137.

The adjustment unit 400 includes, besides the above-mentioned color sensor 501, a communication section 450, a controller 451, a moving motor 571, a slide position sensor 545, and so forth. The operation of the adjustment unit 400 is controlled by the controller 451 mounted in the adjustment unit 400. The controller 451 controls the operations of the motors including the moving motor 571 and the flaps, based on detection signals output from conveying path sensors (not shown) disposed in respective conveying paths within the adjustment unit 400. Further, the controller 451 instructs the color sensor 501 to execute color measurement based on a command received from the printer controller 103 of the printer 100 as the image forming apparatus via the communication section 450. The detection results obtained by the color sensor 501 and the slide position sensor 545 are transmitted to the printer controller 103 via the communication section 450.

Figure 4:
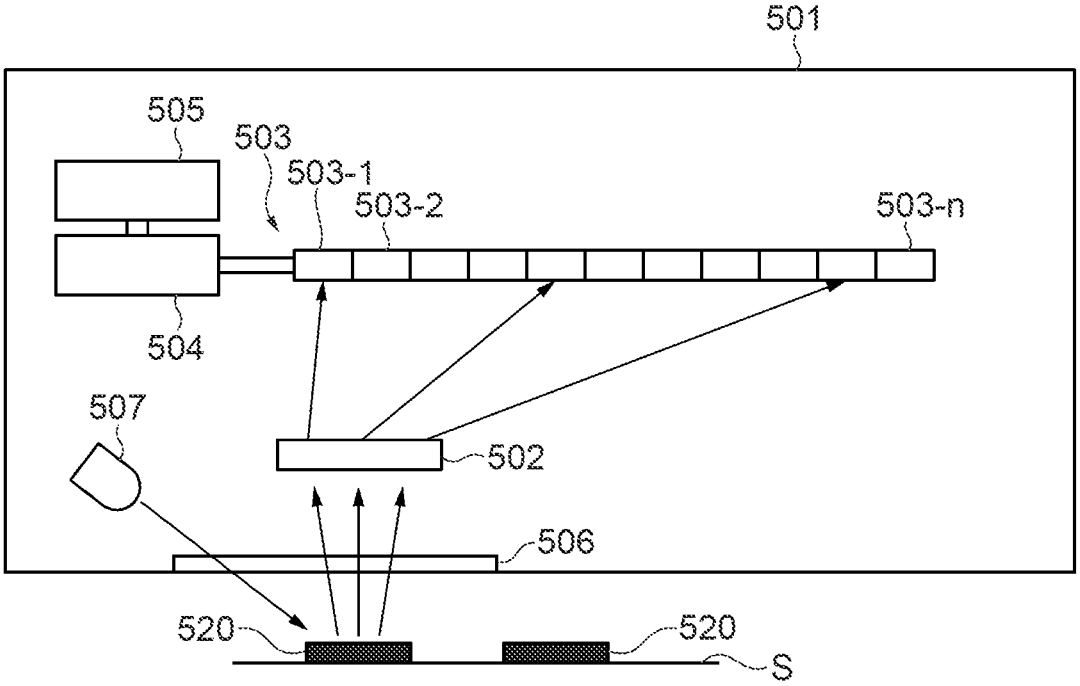
FIG. 4 is a diagram showing the structure of a color sensor.

FIG. 4 is a diagram showing the structure of the color sensor 501. The color sensor 501 includes a light source 507, a diffractive grating element 502, line sensors 503 (503-1 to **503-*n*), a calculation section 504, a memory 505, and a lens 506. The light source 507 is a white LED that irradiates a measurement image 520 on a sheet S with light. The lens 506 converges a light reflected from the measurement image 520 to the diffractive grating element 502. The diffractive grating element 502 spectrally separates the light reflected from the measurement image 520 into components having respective wavelengths. The line sensors 503 are formed by n pixels and each detect a spectrally separated light component having an associated wavelength. The calculation section 504 performs a variety of calculation operations based on a light intensity value of each pixel, which is detected by an associated one of the line sensors 503. The calculation section 504 has a spectral calculation section that calculates a spectral reflectance based on a light intensity value, a Lab calculation section that calculates a Lab value, and so forth. The memory 505** stores a variety of data.

Figure 5A:
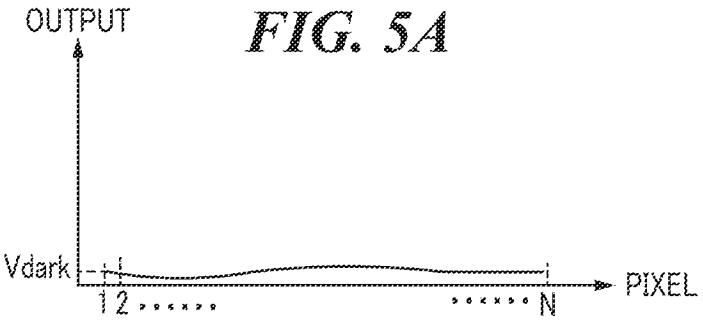
FIGS. 5A to 5E are diagrams useful in explaining a process for calculating a spectral reflectance.
Figure 5B:
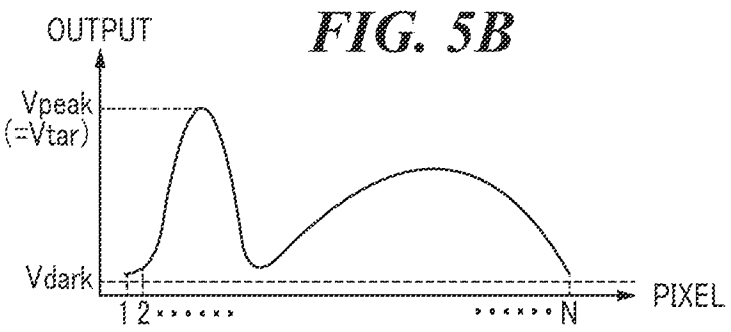
Figure 5C:
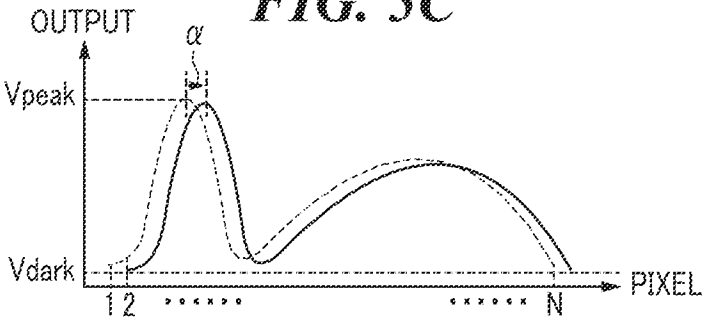
Figure 5D:
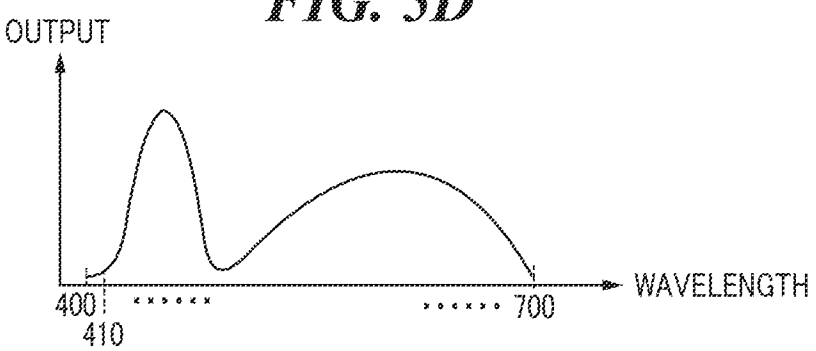
Figure 5E:
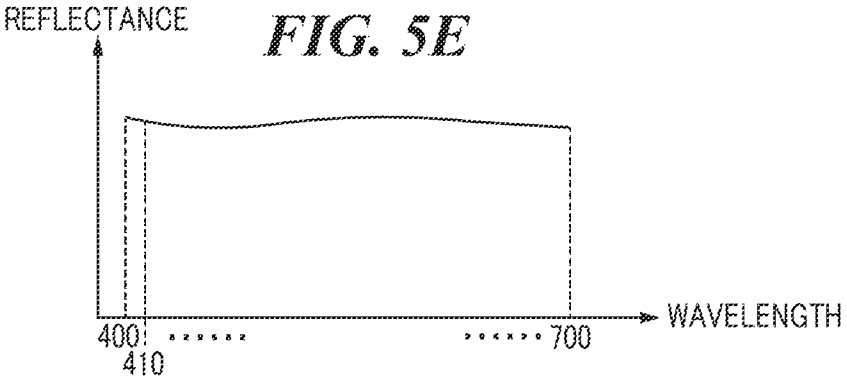

Next, a process for calculating the spectral reflectance will be described with reference to FIGS. 5A to 5E. FIGS. 5A to 5C are diagrams each showing a relationship between pixels and outputs therefrom. FIG. 5D is a diagram showing a relationship between wavelengths and outputs associated therewith. FIG. 5E is a diagram showing a relationship between wavelengths and reflectance associated therewith.

The light source 507 makes the light amount stable by performing forced light emission and then is lighted off. The calculation section 504 measures a dark voltage Vdark output from each line sensor 503 (see FIG. 5A). Next, the calculation section 504 carries out the calibration operation using a white reference plate 800 (see FIGS. 11, 14, and so forth). The calibration operation is executed starting with light amount adjustment. The light amount adjustment is for adjusting a peak output value Vpeak of each line sensor 503 to a target value Vtar (see FIG. 5B). This is performed to correct variation in the output from each line sensor 503, caused due to the service life of the light source 507, dirt on a window surface of the color sensor 501, or changes in temperature of the color sensor 501.

Next, the spectral data of the white reference plate 800 is measured with the adjusted light amount (see FIG. 5C). Then, a positional displacement amount a of light incident on each line sensors 503 is calculated based on the measurement data (represented by a solid line in FIG. 5C). This positional displacement amount a is calculated by comparing the measurement data with spectral data of the white reference plate 800 measured at the factory shipment of the color sensor 501 (represented by a broken line in FIG. 5C). Note that the spectral data of the white reference plate 800 measured at the factory shipment is referred to as the initial white reference plate data, and this data is stored in the memory 505. The positional displacement amount a is corrected, and the output value of each pixel is converted to an output value of each wavelength (see FIG. 5D). This correction is referred to as the distortion correction. Further, conversion of the output value of each pixel to an output value of each wavelength is referred to as the pixel-wavelength conversion. After that, the measurement image is actually measured, dark voltage correction and pixel-wavelength conversion processing are executed on the measured data, and further, the resulting processed data is compared with the spectral data of the white reference plate 800 to calculate spectral reflectance (see FIG. 5E). The spectral reflectance Rp of the measurement image is calculated by the following equation (1):

$$Rp = \text{measurement image spectral data/white reference plate spectral data} \times \text{reference plate reflectance} \quad (1)$$

Note that the reference plate reflectance is data obtained by measuring the reflectance of the white reference plate using a commercially available measurement device, and this data is stored in the memory 505.

Figure 6:
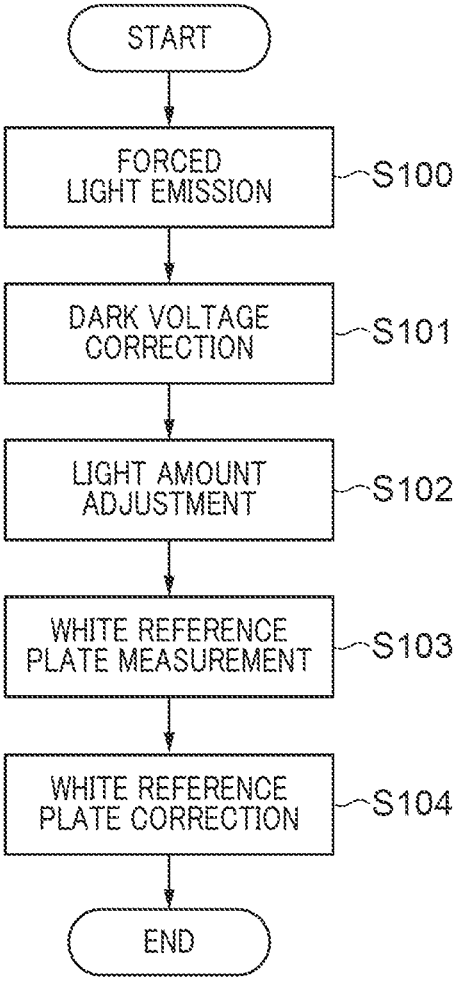
FIG. 6 is a flowchart of a white reference plate calibration process.

FIG. 6 is a flowchart of a white reference plate calibration process. The printer controller 103 includes a CPU, a RAM, and a ROM, none of which are shown. The process in FIG. 6 is realized by the CPU that loads a program stored in the ROM of the printer controller 103 into the RAM and executes the loaded program. At this time, the printer controller 103 controls the color sensor 501 by sending a command to the controller 451.

The printer controller 103 executes forced light emission in a step S100. This forced light emission is performed so as to stabilize the light amount of the light source 507. Note that a time required until the light amount is stabilized is correlated with a time required until the temperature of the light source 507 is stabilized. The printer controller 103 executes dark voltage correction in a step S101 and executes light amount adjustment in a step S102. The printer controller 103 executes measurement of the white reference plate 800 in a step S103 and executes white reference plate correction, i.e. distortion correction in a step S104.

Next, a method of feeding back a result of detection by the color sensor 501 in the printer 100 will be described. In the present embodiment, a basic flow for generating a profile and performing output using the generated profile will be described.

Note that as a profile for realizing excellent color reproducibility, an International Color Consortium (ICC) profile which has been accepted in markets in recent years is used. However, this is not limitative, but any other suitable color management system may be employed in place of the ICC profile. For example, a color rendering dictionary (CRD) employed for PostScript (registered trademark) advocated by Adobe Inc. and a color separation table installed in Adobe Photoshop (registered trademark) can be used. Further, CMYK simulation as a function of ColorWise (registered trademark) of Electronics for Imaging, Inc., for maintaining black plate information, can also be used.

The adjustment unit 400 connected to the printer 100 incorporates the color sensor 501 (see FIG. 2) which can measure a spectral reflectance. The color sensor 501 is capable of measuring a spectral reflectance, and the adjustment unit 400 converts the spectral reflectance to chromaticity to generate a color conversion profile by itself. Then, the adjustment unit 400 performs internal conversion color processing using the generated color conversion profile.

A method of calculating the chromaticity will be described. Light emitted from the white LED hits a measurement target and is reflected therefrom, and the reflected light is spectrally separated by the diffractive grating element and is input to CMOS sensors disposed in respective wavelength regions ranging from 380 mm to 720 mm, which are associated with pixels forming components of a spectral sensor, respectively, for color measurement. The spectral sensor outputs signals indicative of values of spectral reflectance detected based on results of the color measurement. In the present embodiment, to improve the detection and calculation accuracy, the spectral reflectance is converted to L*a*b* data using color-matching functions and the like as defined by CIE. The printer controller 103 obtains a relationship between information converted to L*a*b* data and signal values of the measurement image to generate an ICC profile as a color conversion profile.

The following description will be given of a method of calculating a chromaticity value (L*a*b*) from a spectral reflectance. For example, the coordinates of the L*a*b* color space can be calculated from the spectral reflectance according to a procedure based on ISO 13655 as follows:

a. A spectral reflectance R (λ) of a sample is obtained (λ: 380 nm to 780 nm).

b. Color-matching functions x (λ), y (λ), and z (λ) and standard light spectral distribution SD50 (λ) are made ready for use. Note that the color-matching functions are defined by JIS Z8701. The standard light spectral distribution SD50 (λ) is defined by JIS Z8720 and is also referred to as the auxiliary standard illuminant D50.

c. The spectral reflectance R (λ), the color-matching functions x (λ), y (λ), and z (λ), and the standard light spectral distribution SD50 (λ) are multiplied for each wavelength.

$$R(\lambda) \times SD50(\lambda) \times x(\lambda)$$

$$R(\lambda) \times SD50(\lambda) \times y(\lambda)$$

$$R(\lambda) \times SD50(\lambda) \times z(\lambda)$$

d. The products obtained by the above multiplications in c. are integrated over the entire wavelength regions.

$$\Sigma\{R(\lambda) \times SD50(\lambda) \times x(\lambda)\}$$

$$\Sigma\{R(\lambda) \times SD50(\lambda) \times y(\lambda)\}$$

$$\Sigma\{R(\lambda) \times SD50(\lambda) \times z(\lambda)\}$$

e. An integrated value of products of the color-matching function y (λ) and the standard light spectral distribution SD50 (λ) is calculated.

$$\Sigma\{SD50(\lambda) \times y(\lambda)\}$$

f. The coordinates in the XYZ color space are calculated.

$$X=100\times\Sigma\{SD50(\lambda)\times y(\lambda)\}/\Sigma\{R(\lambda)\times SD50(\lambda)\times x(\lambda)\}$$

$$Y=100\times\Sigma\{SD50(\lambda)\times y(\lambda)\}/\Sigma\{R(\lambda)\times SD50(\lambda)\times y(\lambda)\}$$

$$Z=100\times\Sigma\{SD50(\lambda)\times y(\lambda)\}/\Sigma\{R(\lambda)\times SD50(\lambda)\times z(\lambda)\}$$

g. The XYZ coordinates obtained by the equations in f. are converted to a L*a*b* color space.

$$L^*=116\times(Y/Yn)\hat{}(1/3)-16$$

$$a^*=500\{(X/Xn)\hat{}(1/3)-(Y/Yn)\hat{}(1/3)\}$$

$$b^*=200\{(Y/Yn)\hat{}(1/3)-(Z/Zn)\hat{}(1/3)\}$$

Note that in the above equations in g., Xn, Yn, and Zn are values representing coordinates of a white point used as a reference (standard light tristimulus values). Further, the above equations in g. are transformations used when Y/Yn≥0.008856 holds, and are rewritten in a region where Y/Yn<0.008856 holds as follows:

$$(X/Xn)\hat{}(1/3)\rightarrow 7.78(X/Xn)\hat{}(1/3)+16/116$$

$$(Y/Yn)\hat{}(1/3)\rightarrow 7.78(Y/Yn)\hat{}(1/3)+16/116$$

$$(Z/Zn)\hat{}(1/3)\rightarrow 7.78(Z/Zn)\hat{}(1/3)+16/116$$

Next, details of a profile generation process for generating an ICC profile by the printer 100 will be described. The profile generation process can be executed at a desired timing when a user gives an instruction by operating the console section 180. For example, it is considered that the profile generation process is executed, when an apparatus component is replaced by a customer engineer, or before execution of an image formation job requiring high-level color reproducibility, or further, in a case where a user desires to know a color taste of a final output product at a stage of design planning.

Referring to FIG. 3, when an operation for generating an ICC profile is performed on the console section 180, a signal for instructing generation of a profile is input to the profile generation section 301 of the printer controller 103. The profile generation section 301 sends CMYK signals for outputting a test form (CMYK color chart) defined by ISO 12642 to the engine controller 312 without performing color conversion using an output ICC profile. The profile generation section 301 sends an instruction for performing color measurement (color measuring instruction) using the color sensor 501 to the adjustment unit 400. The printer 100 executes the image formation operation based on the CMYK signals input to the engine controller 312 and forms the test form on a sheet S. The sheet S on which the test form has been formed is conveyed to the adjustment unit 400, and color measurement is performed on the test form by the color sensor 501.

928 items of spectral reflectance data obtained by color measurement of the measurement image are notified to the Lab calculation section 303 of the printer controller 103, so as to be converted to data of the L*a*b* color space by the Lab calculation section 303, and the data of the L*a*b* color space is input to the profile generation section 301. At this time, the data of the L*a*b* color space may be temporarily stored in the color sensor input ICC profile-storing section 304. Note that although in the present embodiment, CIE L*a*b* is employed as a device-independent color space, any other suitable color space (such as a CIE 1931 XYZ color space) may be employed in place of this.

The profile generation section 301 generates an output ICC profile based on a relationship between the CMYK signals sent to the engine controller 312 and the L*a*b* data input thereto. Further, the profile generation section 301 replaces the output ICC profile stored in the output ICC profile-storing section 305 by this output ICC profile.

The output ICC profile has, for example, a structure as shown in FIG. 7, and is formed by a header, a tag, and data thereof. The test form defined by ISO 12642 includes CMYK color signals that cover color reproduction regions which can be output by a general copy machine. The profile generation section 301 generates a CMYK to L*a*b*conversion table (A2Bx tag), based on the CMYK signals used to output the test form and the L*a*b* values obtained from the color measurement results. Further, a L*a*b* to CMYK reverse conversion table (B2Ax tag) is generated based on the CMYK to L*a*b*conversion table. As a tag indicating other data, a white point (wtpt), a tag (gamt) describing whether one color associated therewith is inside or outside a reproduction range reproducible by a hard copy, and so forth are also described in the output ICC profile.

Note that in a case where a command for executing the profile generation process is input from an external device via an external interface 308, the ICC profile generated by the profile generation section 301 may be transmitted to the external device. In this case, a user can cause an application adapted to the ICC profile to perform color conversion on the external device.

Next, a description will be given of a color conversion process performed on input image data in a case where an image formation job is input to the printer 100. In the block diagram shown in FIG. 3, image data received by the printer controller 103 via the external interface 308 is sent to the input ICC profile-storing section 307 for external input. In general color printing, a case is assumed in which the image data is expressed by RGB values or standard print CMYK signal values, such as Japan Color.

In the input ICC profile-storing section 307, RGB to L*a*b* conversion or CMYK to L*a*b* conversion is performed according to input image signals. The input ICC profile is formed by a one-dimensional LUT (lookup table) for controlling gamma of the input signals, a multi-color LUT referred to as direct mapping, and a one-dimensional LUT for controlling gamma of generated conversion data. By using these tables, device-dependent color space is converted to device-independent L*a*b* data.

The image signals converted to the L*a*b* chromaticity coordinates are input to the CMM 306. Then, GAMUT conversion, color conversion, black character determination, and so forth are performed on the image signals. In the GAMUT conversion, mismatches between a reading color space of the external interface 308 via which is input image data from a scanner section or the like as an input device and an output color reproduction range of the printer 100 as an output device are mapped. Further, color conversion for adjusting a mismatch between a light source type at the time of input data and a light source type at the time of viewing an output product (also referred to as the mismatch in color temperature setting), black character determination, and so forth are performed.

With this, the L*a*b* data is converted to L*'a*'b*' data, and input to the output ICC profile-storing section 305. A profile newly generated by the profile generation section 301 is stored in the output ICC profile-storing section 305, as described above. Then, the input L*'a*'b*' data is subjected to color conversion using the newly generated ICC profile, thereby being converted to the CMYK (Cyan Magenta Yellow Black) signals which depend on the output device, for output.

Figure 8:
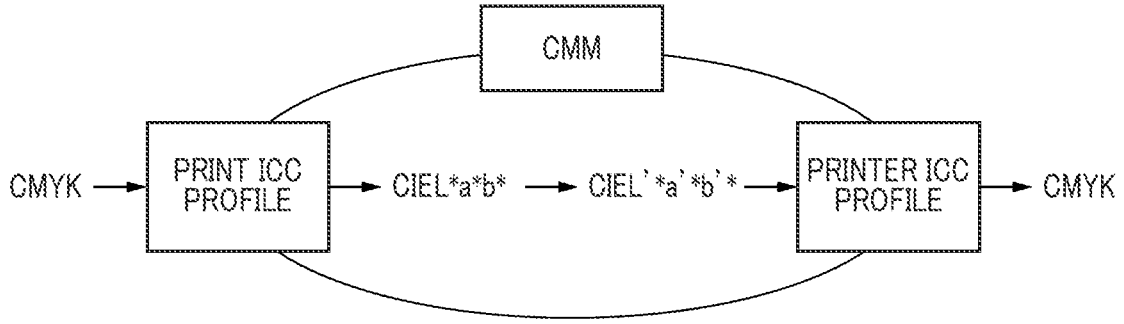
FIG. 8 is a diagrammatic sketch of a color management environment.

FIG. 8 is a diagrammatic sketch of a color management environment. In the block configuration shown in FIG. 3, the CMM 306 is separated from the input ICC profile-storing section 307 and the output ICC profile-storing section 305. However, as shown in FIG. 8, the CMM refers to a module that controls color management and performs color conversion using an input profile and an output profile.

Figure 9:
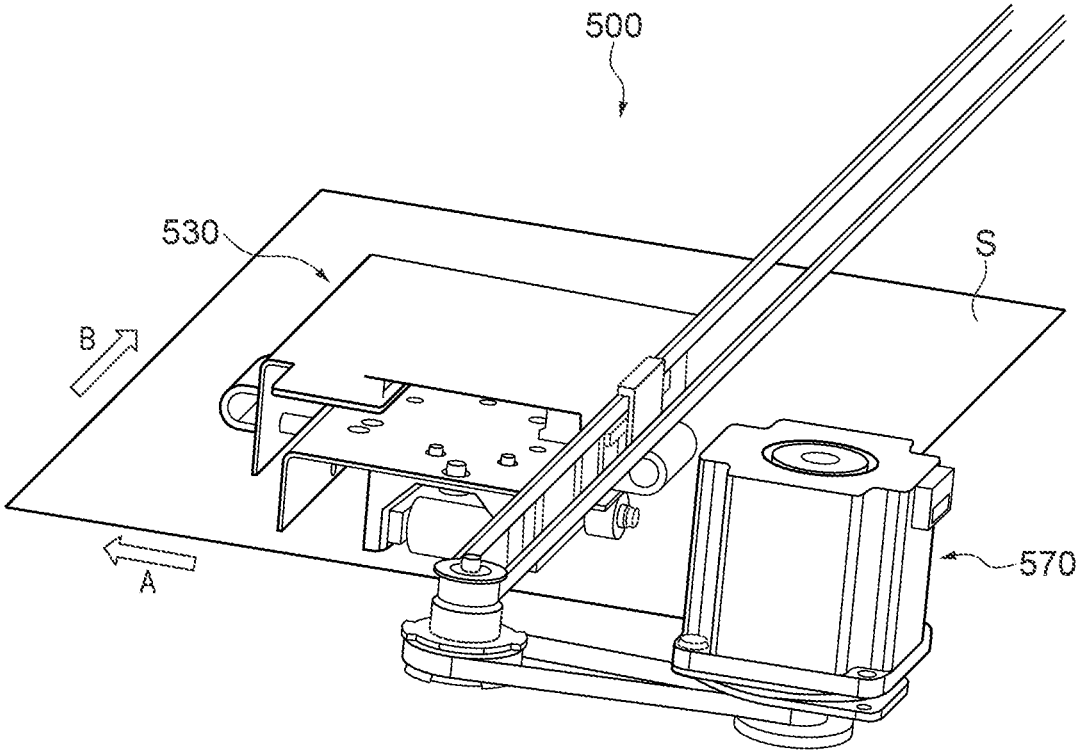
FIG. 9 is a perspective view of a color measuring unit and associated elements.
Figure 10:
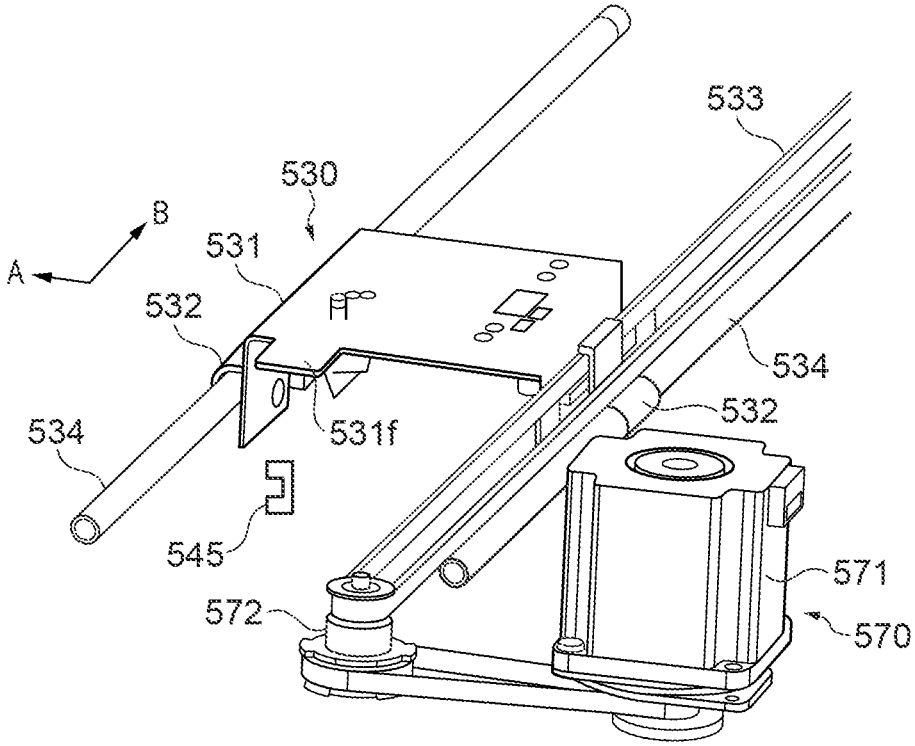
FIG. 10 is a perspective view of the color measuring unit and the associated elements.
Figure 11:
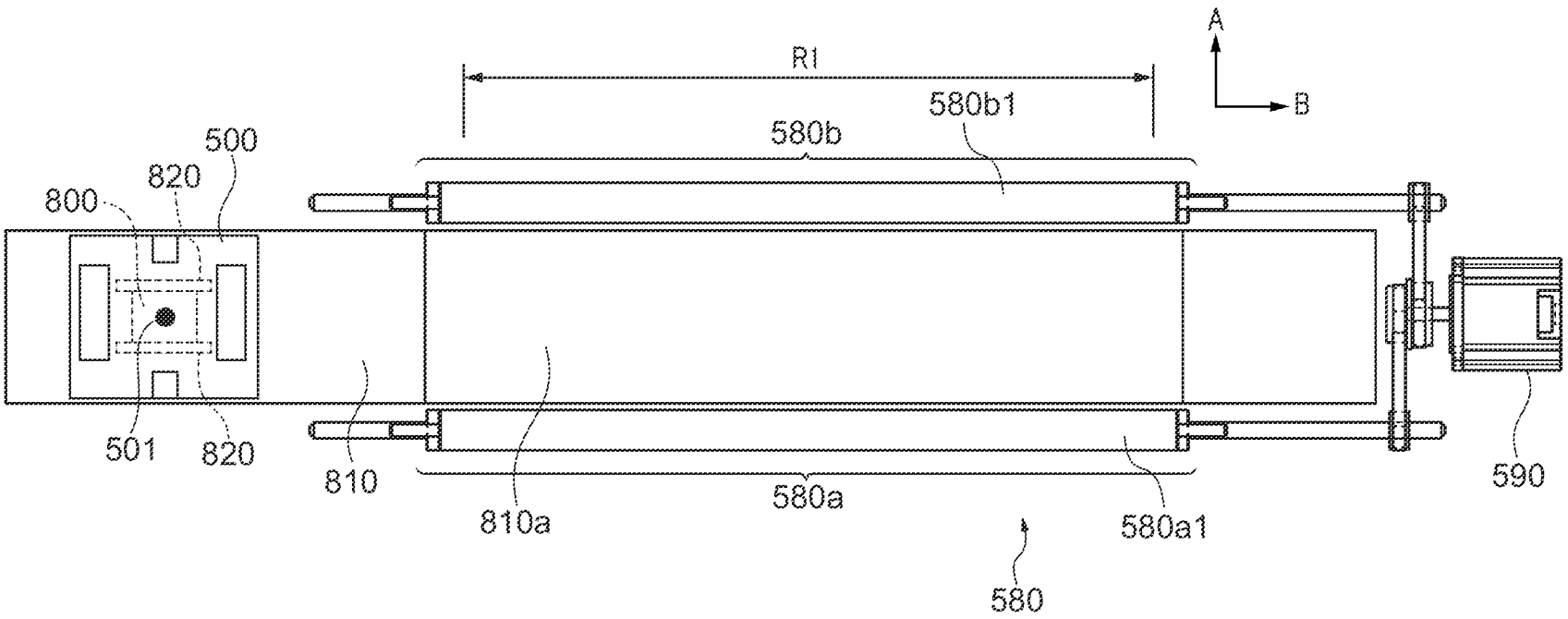
FIG. 11 is a plan view of the color measuring unit and peripheral components.

Next, the configuration and operation of the color measuring unit 500 including the color sensor 501 will be described with reference to FIGS. 9 to 12. FIGS. 9 and 10 are perspective views of the color measuring unit 500 and associated elements. FIG. 11 is a plan view of the color measuring unit 500 and the peripheral components.

The color measuring unit 500 includes a moving unit 530, a driving unit 570 (driving section), the slide position sensor 545 (see FIG. 10), and the white reference plate 800 (see FIG. 11) as the main components. The peripheral components of the color measuring unit 500 include a conveying roller unit 580, a conveyance drive unit 590, and a backing member 810 (see FIG. 11).

The moving unit 530 includes the color sensor 501 and moves between a far side and a near side of the adjustment unit 400 shown in FIG. 2. The left side as viewed in FIG. 11 corresponds to the near side. Hereafter, a direction of conveying the sheet S is defined as a sheet passing direction A. A direction substantially orthogonal to the sheet passing direction A and a sheet surface (sheet width direction) is a moving direction B of the color sensor 501. The driving unit 570 drives the moving unit 530 to so as to cause the same to move.

The conveying roller unit 580 conveys the sheet S. The conveyance drive unit 590 drives the conveying roller unit 580. After the conveying roller unit 580 receives the sheet S in the sheet passing direction A, the color sensor 501 measures color as the moving unit 530 moves in the moving direction B.

As shown in FIG. 10, in the moving unit 530, moving bearings 532 are mounted on a moving support plate 531. One of the moving bearings 532 is engaged with a moving belt 533 via a gear tooth surface and both of the moving bearings 532 are engaged with moving shafts 534. The moving belt 533 is engaged with the moving motor 571 via a moving pulley 572. Therefore, when the moving motor 571 is operated, the moving unit 530 is driven via the moving pulley 572 and the moving belt 533 to reciprocally move in a direction parallel to the moving direction B. A movement amount of the moving unit 530 is controlled by predetermined pulses sent thereto after ON/OFF of the slide position sensor 545 is switched by a flag portion 531*f* of the moving support plate 531.

As shown in FIG. 11, an area of the backing member 810, which extends under the conveying roller unit 580, forms a conveying guide surface 810*a* (sheet conveying surface) for conveying the sheet S. The white reference plate 800 is disposed on a left end portion of the backing member 810 in FIG. 11. A sheet passing area R1 is an area where the sheet S is conveyed. The white reference plate 800 is located outside the sheet passing area R1.

The conveying roller unit 580 has an upstream unit 580*a* on an upstream side in the sheet passing direction A, and the upstream unit 580*a* includes an upstream conveyance driving roller 580*a*1 and an upstream conveyance driven roller (not shown). The upstream conveyance driving roller 580*a*1 is formed by applying urethane coating having a thickness of 30 μm to an outer periphery of a pipe formed of an aluminum material, and has an outer diameter of 20 mm. The upstream conveyance driving roller 580*a*1 has opposite ends thereof rotatably supported by bearings (not shown) and is driven for rotation by the conveyance drive unit 590.

The upstream conveyance driven roller is brought into pressure contact with the upstream conveyance driving roller 580*a*1 by a spring (not shown), and a nip is formed by the upstream conveyance driving roller 580*a*1 and the upstream conveyance driven roller. The upstream conveyance driven roller is formed by wrapping silicone rubber on a surface of the roller formed of an aluminum material, and has an outer diameter of 20 mm. The upstream conveyance driven roller is also rotatably supported by bearings (not shown). The upstream conveyance driven roller is driven for rotation by the upstream conveyance driving roller 580*a*1.

Further, the conveying roller unit 580 has a downstream unit 580*b* on a downstream side in the sheet passing direction A, and the downstream unit 580*b* includes a downstream conveyance driving roller 580*b*1 and a downstream conveyance driven roller (not shown). The downstream unit 580*b* has the same configuration as that of the upstream unit 580*a*, and hence description thereof is omitted.

In the present embodiment, the driving force generated by the conveyance drive unit 590 is transmitted to the upstream conveyance driving roller 580*a*1 of the upstream unit 580*a* and the downstream conveyance driving roller 580*b*1 of the downstream unit 580*b* of the conveying roller unit 580. However, a conveyance driving unit may be provided for each of the upstream conveyance driving roller 580*a*1 of the upstream unit 580*a* and the downstream conveyance driving roller 580*b*1 of the downstream unit 580*b*, for transmission of the driving force thereto.

Figure 12A:
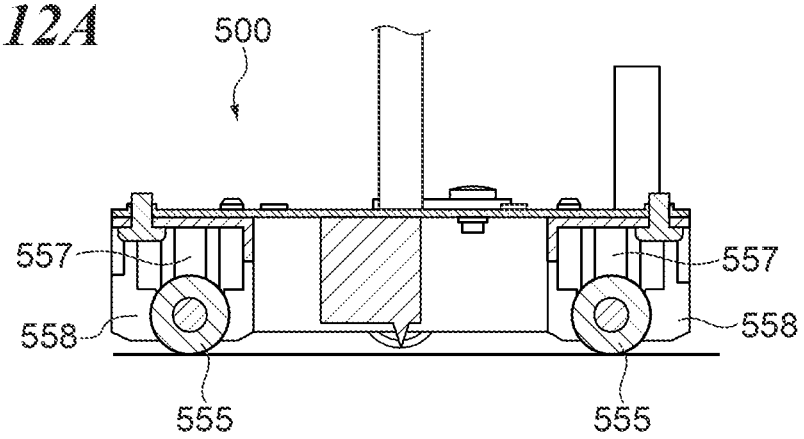
FIGS. 12A to 12C are cross-sectional views and a plan view of essential parts of the color measuring unit.
Figure 12B:
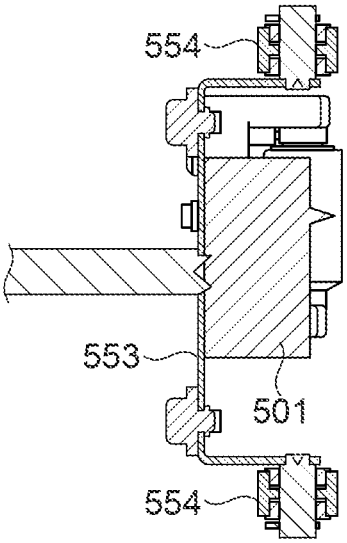
Figure 12C:
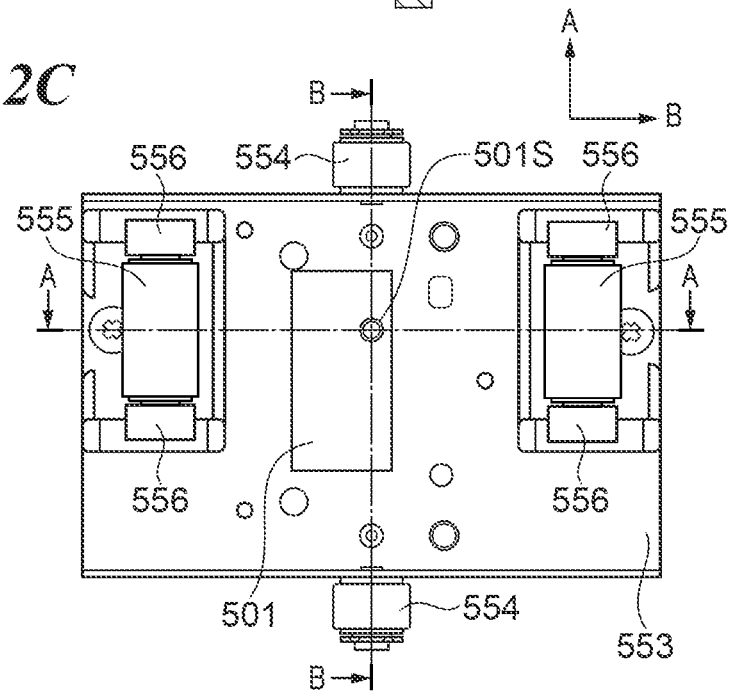

FIG. 12C is a plan view of essential parts of the color measuring unit 500. FIGS. 12A and 12B are a cross-sectional view taken along A-A and a cross-sectional view taken along B-B in FIG. 12C, respectively. The color sensor 501 is mounted on a support plate 553 and incorporated in the color measuring unit 500. A pair of fixed rollers 554 (rotating members) are disposed at opposite ends of the support plate 553 in the sheet passing direction A, respectively. A pair of lifting rollers (retaining portions) 555 are disposed at opposite ends of the support plate 553 in the moving direction B, provided with, respectively.

As viewed in plan view, the rotational axis of the pair of fixed rollers 554 passes the reading portion 501S of the color sensor 501. Therefore, in the moving direction B, the position of the rotational axis of the pair of fixed rollers 554 and the center position of the color sensor 501 substantially coincide with each other. Each fixed roller 554 is brought into contact with the sheet S, whereby the color sensor 501 can scan the sheet S while maintaining a constant relative distance to a measurement target surface (surface of the sheet S). Therefore, the pair of fixed rollers 554 maintain the distance between the color sensor 501 and the sheet S as the measurement target at a predetermined distance. Further, the fixed rollers 554 are disposed at respective positions different from the white reference plate 800 in the sheet passing direction A.

The pair of lifting rollers 555 are rotating members (roller members) whose longitudinal direction is the sheet passing direction A. The rotational axis of each lifting roller 555 is substantially parallel to the sheet passing direction A. As viewed in plan view, the pair of lifting rollers 555 are disposed on a straight line parallel to the moving direction B, which passes the reading portion 501S. Each lifting roller 555 is mounted on the support plate 553 via lifting roller bearings 556, a lifting roller spring 557 (resilient member), and a lifting roller holder 558. Therefore, the pair of lifting rollers 555 are movable in a direction perpendicular to the conveying guide surface 810*a* and each are urged toward the conveying guide surface 810*a* (toward the sheet S in the direction perpendicular to the conveying guide surface 810*a*) by the lifting roller spring 557.

The color sensor 501 is reciprocally movable in the moving direction B. The pair of lifting rollers 555 move together with the color sensor 501 and hold the sheet S as the measurement target in the moving process of the color sensor 501. In at least part of the moving process of the color sensor 501, at least part of the pair of lifting rollers 555 overlaps the white reference plate 800 as viewed from a direction perpendicular to a reference surface 800*a* (see FIG. 14). For example, when the color sensor 501 moves on the white reference plate 800, there is a scene where the pair of lifting rollers 555 overlap the white reference plate 800 in plan view.

Figure 13:
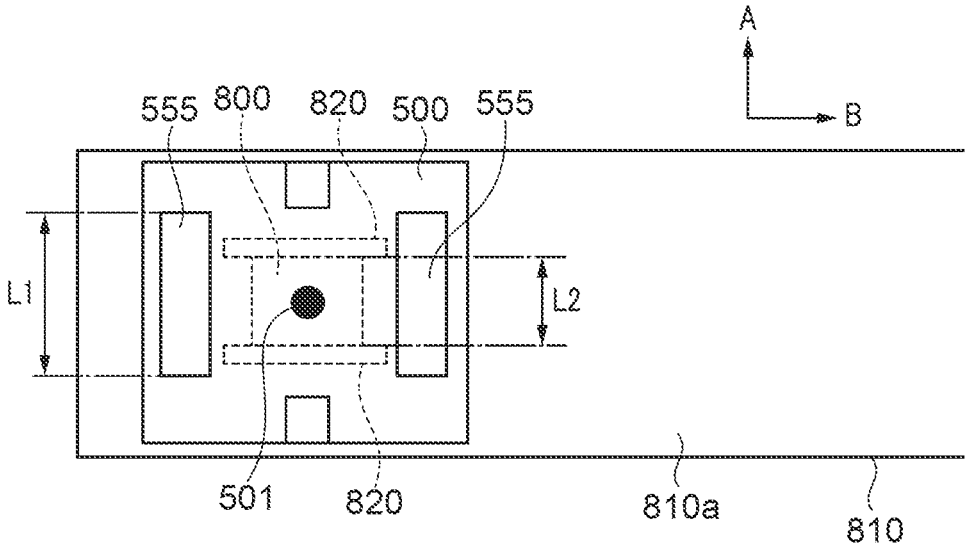
FIG. 13 is a plan view of the color measuring unit and its surroundings.
Figure 14:
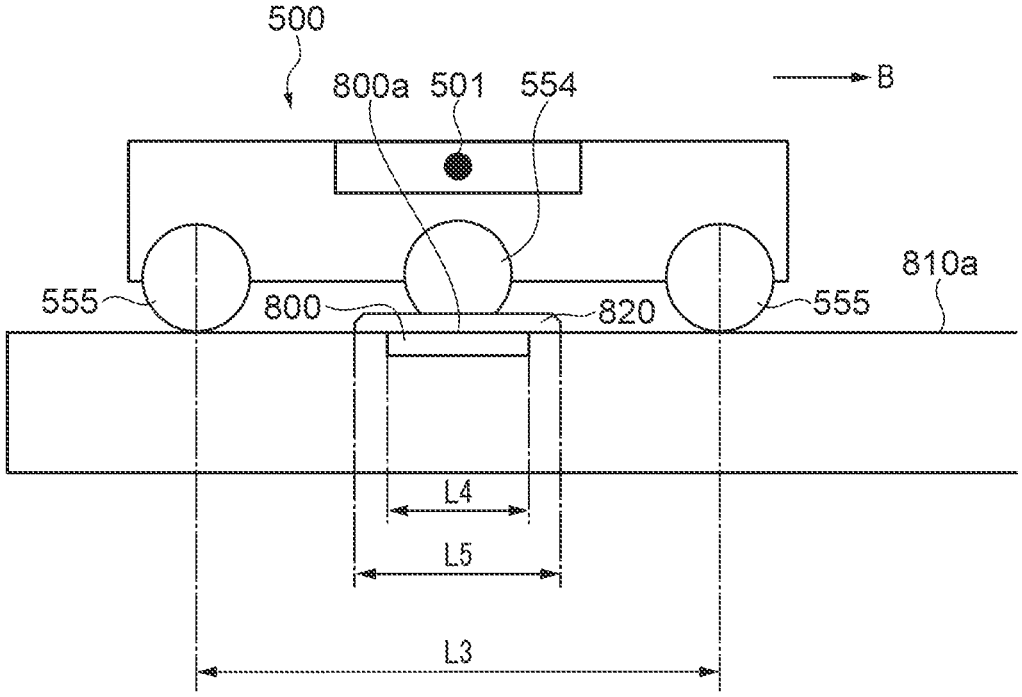
FIG. 14 is a side view of the color measuring unit and its surroundings.

FIGS. 13 and 14 are a plan view and a side view of the color measuring unit 500 and its surroundings, respectively.

As shown in FIG. 13, the backing member 810 is provided with a pair of slid-on members 820 on opposite sides of the white reference plate 800 in the sheet passing direction A such that the pair of slid-on members 820 protrude from the he conveying guide surface 810*a* of the backing member 810. The slid-on members 820 are integrally formed e.g. with the backing member 810 at respective locations across the white reference plate 800 in the sheet passing direction A. The position of an upper end of each slid-on member 810 is higher than the reference surface 800*a*. The conveying guide surface 810*a* and the reference surface 800*a* of the white reference plate 800 are on substantially the same plane (see FIG. 14). The pair of slid-on members 820 each have the same shape. Each slid-on member 820 is a rib-shaped protruding portion which is long in the moving direction B.

A relationship between the lifting rollers 555 and the slid-on member 820 will be described. As shown in FIG. 13, a length of each lifting roller 555 in the sheet passing direction A is represented by L1. A distance between the pair of slid-on members 820 in the sheet passing direction A is represented by L2. Note that the distance L2 is defined as the shortest distance between the pair of slid-on members 820 in the sheet passing direction A, but may be defined as a distance between the respective center positions of the slid-on members 820 in the sheet passing direction A.

Here, the length L1 is longer than the distance L2, i.e. the relationship of L1>L2 holds. With this, the lifting rollers 555 both roll while being in contact with the two slid-on members 820, respectively. Therefore, as viewed from the direction perpendicular to the reference surface 800*a*, when the lifting rollers 555 move in an area where at least part of the lifting rollers 555 overlaps the white reference plate 800, the lifting rollers 555 positively ride on the pair of slid-on members 820, whereby a space between the lifting rollers 555 and the reference surface 800*a* is secured. That is, since the lifting rollers 555 are brought into contact with the pair of slid-on members 820, a space is formed between the lifting rollers 555 and the reference surface 800*a*. As a result, the lifting rollers 555 are prevented from being brought into contact with the white reference plate 800 disposed between the two slid-on members 820, and sticking of dirt on the reference surface 800*a* is avoided.

As shown in FIG. 14, a distance between the two lifting rollers 555 in the moving direction B is represented by L3. Note that the distance L3 is defined by a distance between the respective center positions of the lifting rollers 555 in the moving direction B, but may be defined by the shortest distance between the lifting rollers 555. A length of the white reference plate 800 in the moving direction B is represented by L4. A length of each slid-on member 820 in the moving direction B is represented by L5. The distance L3 is larger than the length L5, and the length L5 is larger than the length L4. That is, the relationship of L3>L5>L4 holds. This prevents the lifting rollers 555 from remaining in a state riding on the slid-on members 820 in the moving process of the color sensor 501 when the calibration operation is carried out. For example, when reading the white reference plate 800, the two lifting rollers 555 are brought into contact with the conveying guide surface 810*a* in a posture straddling the slid-on members 820, and hence a distance between the color sensor 501 and the white reference plate 800 is properly ensured. Therefore, it is possible to read the white reference plate 800 with high accuracy.

Next, the measurement operation of the color sensor 501 will be described with reference to FIGS. 15A, 15B, 16A, and 16B. FIGS. 15A and 15B and FIGS. 16A and 16B are plan views of the color measuring unit 500 and the peripheral components. In FIGS. 16A and 16B, the sheet S being conveyed is also illustrated.

Figure 15A:
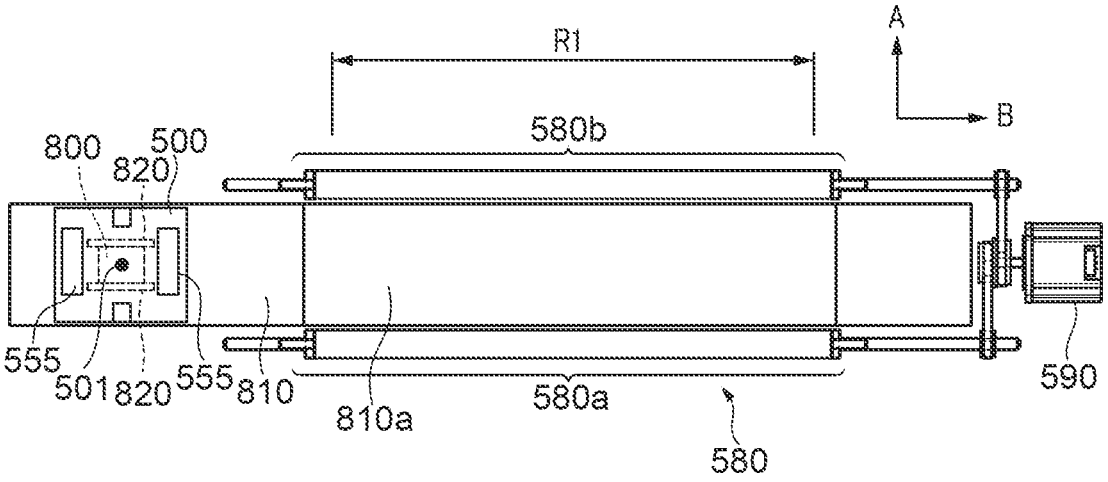
FIGS. 15A and 15B are plan views of the color measuring unit and associated peripheral components.
Figure 16A:
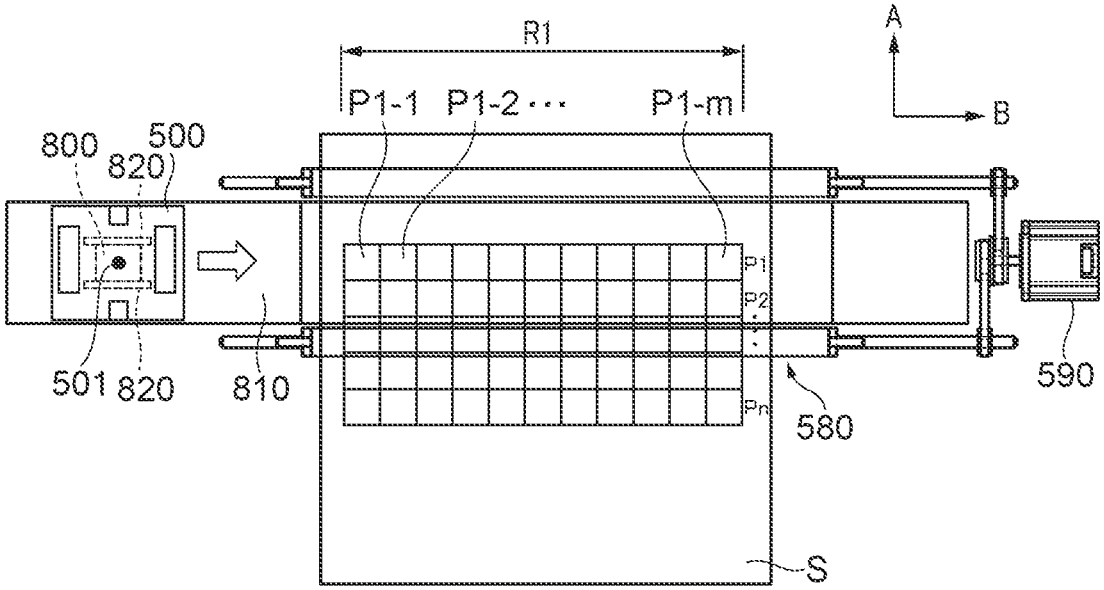
FIGS. 16A and 16B are plan views of the color measuring unit and the peripheral components.
Figure 16B:
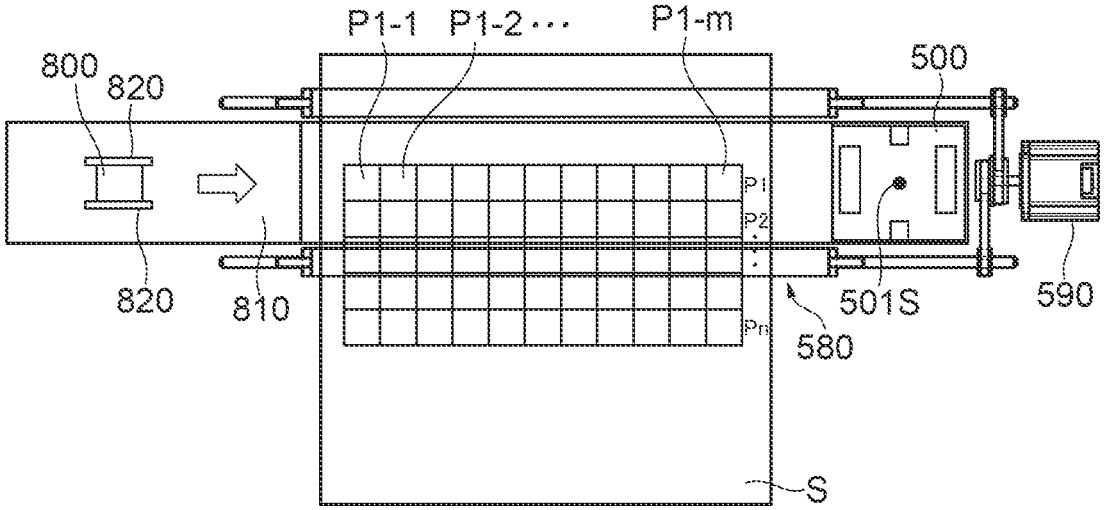

First, the color sensor 501 remains on standby above the white reference plate 800 (see FIG. 15A). This position of the color sensor 501 is referred to as the standby position. The standby position is outside the range of the sheet passing area R1, and the arrangement position of the white reference plate 800 is also outside the sheet passing area R1. The color sensor 501 can move in an area including the white reference plate 800 and the sheet passing area R1 in a direction substantially parallel to the moving direction B.

Figure 15B:
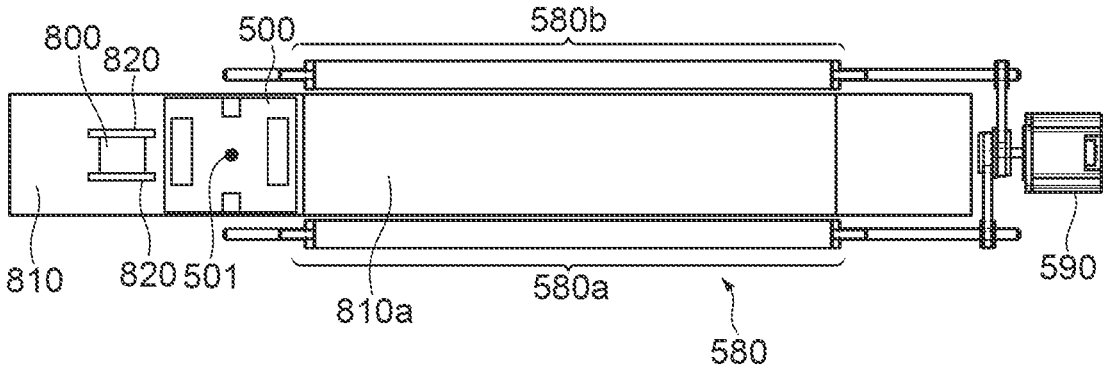

When starting the measurement operation, the color sensor 501 moves away from the white reference plate 800 by 100 mm in the moving direction B (see FIG. 15B). At this time, the lifting rollers 555 move while riding on the pair of slid-on members 820. Since the slid-on members 820 are higher than the reference surface 800*a* of the white reference plate 800, even when the lifting rollers 555 pass over the white reference plate 800, the lifting rollers 555 are prevented from being brought into contact with the white reference plate 800.

The color sensor 501 forcibly emits light only for 45 seconds in a state having moved away from the white reference plate 800 (see FIG. 15B). After that, the color sensor 501 returns to the position above the white reference plate 800 (see FIG. 15A). When the lifting rollers 555 pass over the white reference plate 800 in this moving process, the lifting rollers 555 are also prevented from being brought into contact with the white reference plate 800. After the color sensor 501 has returned to the standby position, the above-mentioned calibration is performed by the color sensor 501, and the color sensor 501 remains on standby until a sheet S is conveyed.

The sheet S has n rows×m columns of measurement images formed thereon. In a first row, m measurement images of P1-1, P1-2, . . . , and P1-*m* are formed, and such images are formed for n rows of P1, P2, . . . , and Pn. The controller 451 controls the conveying roller unit 580 based on a result of detection performed by the feed timing sensor 116, whereby the sheet S can be conveyed over a predetermined distance and stopped. As shown in FIG. 16A, the sheet S is conveyed within the range of the sheet passing area R1.

When conveying the sheet S, the color sensor 501 is on standby in the standby position as shown in FIG. 15A. The sheet S is conveyed to and stopped at a color measuring position which is aligned with the position of the color sensor 501 and the position of the measurement images P1-1 to P1-*m* in the first row (see FIG. 16A). In this state of the sheet S, the color sensor 501 reads the m measurement images in the first row while moving in the moving direction B and then stops at an end position. That is, the color sensor 501 reaches the end position opposite from the standby position across the sheet passing area R1 (see FIG. 16B). The end position is also outside the sheet passing area R1.

As shown in FIG. 16B, in a state in which the color sensor 501 is positioned in the end position, the sheet S is conveyed to and stopped at a color measuring position which is aligned with the position of the color sensor 501 and the position of the measurement images P2-1 to P2-*m* in a second row. In this state of the sheet S, the color sensor 501 reads the m measurement images in the second row while moving in a direction parallel to the moving direction B. The same operation is repeated n times, whereby it is possible to read all of the n×m measurement images.

According to the present embodiment, the slid-on members 820 higher than the reference surface 800*a* of the white reference plate 800 are provided on the backing member 810. Therefore, when the color sensor 501 moves in the area where at least part of the lifting rollers 555 overlaps the white reference plate 800 as viewed from the direction perpendicular to the reference surface 800*a*, the lifting rollers 555 ride on the slid-on members 820. With this, a space between the lifting rollers 555 and the reference surface 800*a* is secured, whereby it is possible to avoid dirt from sticking to the reference surface 800*a* due to contact with the lifting rollers 555. Although the color measurement device has the configuration including the movable type color sensor 501, it is not required to provide a member for protecting the reference surface 800*a*, such as a shutter, and hence it is possible to simplify the configuration and suppress increase in the costs. Therefore, it is possible to prevent the reference surface 800*a* from becoming dirty with the simple and low-cost configuration. Further, since the white reference plate 800 is positioned outside the sheet passing area R1, paper powder generated from the sheet S is less liable to be accumulated on the white reference plate 800.

Further, the distance between the color sensor 501 and the sheet S as the measurement target is ensured by the pair of fixed rollers 554. Particularly, since the position of the rotational axis of the pair of fixed rollers 554 and the position of the color sensor 501 substantially coincide with each other in the moving direction B, the relative distance between the color sensor 501 and the sheet S is maintained constant with high accuracy. Therefore, the accuracy of reading the measurement image is high and has little variation.

Further, the length L1 of each lifting roller 555 in the sheet passing direction A is larger than the distance L2 between the pair of slid-on members 820 (L1>L2). Therefore, when the lifting rollers 555 move in the vicinity of the white reference plate 800, the lifting rollers 555 positively ride on the pair of slid-on members 820. With this, sticking of dirt to the reference surface 800*a* is positively avoided.

Further, the distance L3 between the two lifting rollers 555, the length L4 of the white reference plate 800, and the length L5 of each slid-on member 820 in the moving direction B have the relationship of L3>L5>L4. This prevents the lifting rollers 555 from remaining in a state riding on the slid-on members 820 when reading the white reference plate 800. Therefore, it is possible to read the white reference plate 800 with high accuracy.

Figure 17:
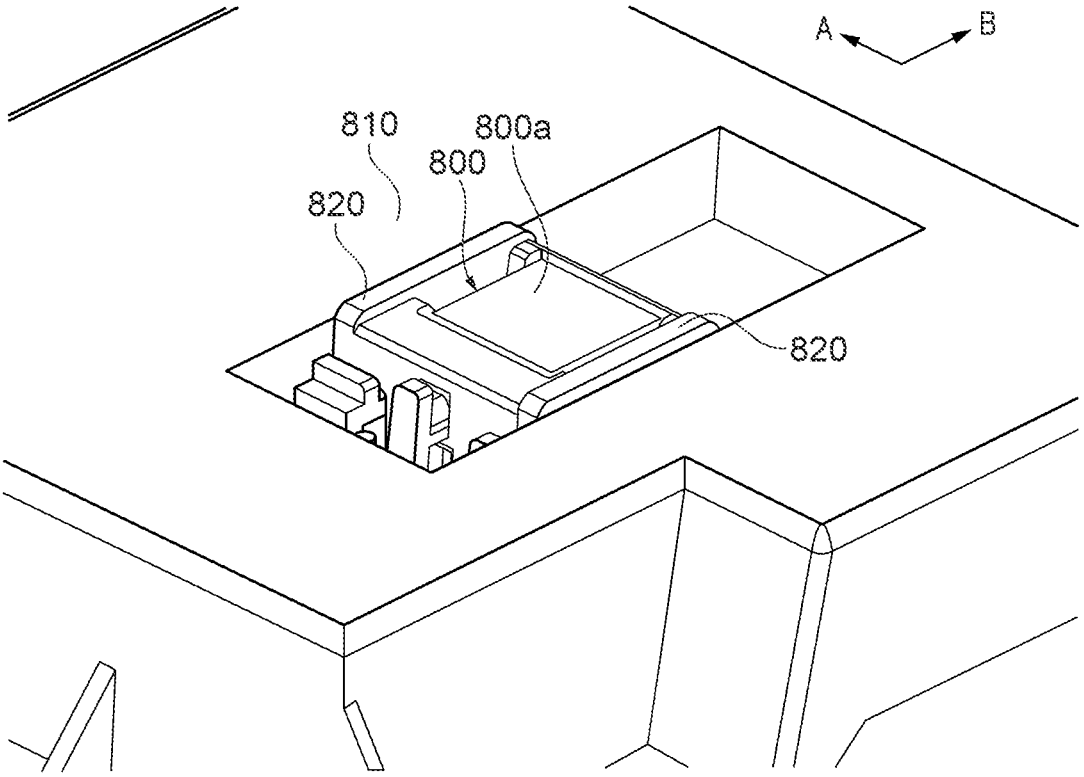
FIG. 17 is a view showing a variation of slid-on members.

Note that in the present embodiment, the slid-on members 820 are formed on the backing member 810 which is a holding unit that holds the white reference plate 800. However, each slid-on member 820 is only required to be formed as a protruding portion that protrudes to a level higher than the reference surface 800*a* in the height direction, and may be fixed directly or indirectly to the white reference plate 800, or may be formed integrally with the white reference plate 800. For example, as shown in a variation in FIG. 17, the slid-on members 820 as the protruding portions may be integrally formed with the white reference plate 800. In the illustrated example in FIG. 17, the slid-on members 820 protruding higher than the reference surface 800*a* are integrally formed on the opposite ends of the white reference plate 800 in the sheet passing direction A.

Note that although the lifting rollers 555 are described as the retaining portions for retaining the sheet S as the measurement target in the moving process of the color sensor 501 by way of example, this is not limitative. For example, the retaining portions may be members that slide on the sheet S without rotating.

The description has been given of the example in which the color measuring unit 500 to which the present invention is applied is mounted on the adjustment unit 400. However, the color measuring unit to which the present invention is applied may be mounted on the printer 100. For example, the present invention may be applied to the color measuring unit 200 (see FIG. 1). In this case, the printer controller 103 controls the color measuring unit 200. Further, the image forming system 1000 may include a connection unit other than the adjustment unit 400 and the finisher 600, and the connection unit equipped with the color measuring unit to which the present invention is applied is not limited. Further, as in the image forming system 1000, an image forming system including at least one connection unit, such as the adjustment unit 400, may be regarded as the "image forming apparatus".

Note that in the present embodiment, a word to which "substantially" is attached is not intended to exclude meaning of "complete". For example, "substantially matching", "substantially the same", "substantially parallel", "substantially orthogonal", "substantially vertical direction", and "substantially horizontal direction" include "completely matching", "completely the same", "completely parallel", "completely orthogonal", "completely vertical direction", and "completely horizontal direction", respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-008888, filed Jan. 22, 2021, which is hereby incorporated by reference herein in its entirety.

What is claimed is:

1. A color measurement device, comprising:

a conveying unit configured to convey a sheet in a conveying direction;

a color measurement unit configured to be movable in a direction crossing the conveying direction, and measure a color of an image formed on the sheet conveyed by the conveying unit;

a reference member having a reference surface measured by the color measurement unit for calibration of the color measurement unit;

a retaining portion that moves together with the color measurement unit and retains the sheet for measurement by the color measurement unit; and a protruding portion that protrudes to a level higher than the reference surface in a direction perpendicular to the reference surface, wherein when the color measurement unit moves such that at least part of the retaining portion overlaps the reference member as viewed from the direction perpendicular to the reference surface, the retaining portion is brought into contact with the protruding portion, whereby a space is formed between the retaining portion and the reference surface.

2. The color measurement device according to claim 1, further comprising a rotating member that moves together with the color measurement unit and is brought into contact with the sheet for measurement by the color measurement unit to thereby maintain a distance between the color measurement unit and the sheet at a predetermined distance.

3. The color measurement device according to claim 2, wherein a position of the rotating member and a position of the color measurement unit in a moving direction of the color measurement unit substantially coincide with each other.

4. The color measurement device according to claim 2, wherein the rotating member is disposed at a location different in the conveying direction from the reference member.

5. The color measurement device according to claim 1, wherein the protruding portion is provided in pair on opposite sides of the reference surface in the conveying direction, and wherein a length of the retaining portion in the conveying direction is longer than a distance between the pair of protruding portions in the conveying direction.

6. The color measurement device according to claim 1, wherein the retaining portion is provided in pair on opposite sides of the color measurement unit in the moving direction of the color measurement unit, and wherein a distance between the pair of retaining portions in the moving direction is larger than a length of the protruding portion in the moving direction, and the length of the protruding portion in the moving direction is larger than a length of the reference member in the moving direction.

7. The color measurement device according to claim 1, wherein the retaining portion is movable in the direction perpendicular to the reference surface and is urged toward the reference member by an resilient member.

8. The color measurement device according to claim 1, wherein the protruding portion is formed on a holding unit that holds the reference member.

9. The color measurement device according to claim 1, wherein the protruding portion is formed on the reference member.

10. The color measurement device according to claim 1, wherein the reference member is disposed outside an area where the sheet conveyed by the conveying unit passes.

11. The color measurement device according to claim 1, wherein the retaining portion is a roller member that is rotatably supported.

12. An image forming apparatus, comprising:

an image forming unit configured to form an image on a sheet;

a conveying unit configured to convey a sheet on which the image has been formed by the image forming unit in a conveying direction;

a color measurement unit configured to be movable in a direction crossing the conveying direction, and measure a color of the image formed on the sheet conveyed by the conveying unit;

a reference member that is disposed outside an area where the sheet conveyed by the conveying unit passes and has a reference surface measured by the color measurement unit for calibration of the color measurement unit;

a retaining portion that moves together with the color measurement unit and retains the sheet for measurement by the color measurement unit; and a protruding portion that protrudes to a level higher than the reference surface in a direction perpendicular to the reference surface, wherein when the color measurement unit moves such that at least part of the retaining portion overlaps the reference member as viewed from the direction perpendicular to the reference surface, the retaining portion is brought into contact with the protruding portion, whereby a space is formed between the retaining portion and the reference surface.

* * * * *